US006311898B1

(12) United States Patent
Gruff

(10) Patent No.: US 6,311,898 B1
(45) Date of Patent: Nov. 6, 2001

(54) SEALED-CELL WATERFALL DISPLAY UNIT

(76) Inventor: Gregory Phillip Gruff, 1976 Britains La., Columbus, OH (US) 43224

( * ) Notice: Subject to any disclaimer, the term of this patent is extended or adjusted under 35 U.S.C. 154(b) by 0 days.

(21) Appl. No.: 09/521,033

(22) Filed: Mar. 8, 2000

(51) Int. Cl.[7] ..... B05B 17/08; B05B 1/36

(52) U.S. Cl. ..... 239/17; 239/16; 239/20; 239/23; 239/193; 239/211; 40/406

(58) Field of Search ..... 239/16, 17, 20, 239/23, 193, 211; D23/201; 40/406, 409

(56) References Cited

U.S. PATENT DOCUMENTS 1,458,208 * 6/1923 Houghton ..... 40/406
3,211,378 10/1965 Zysk .
3,842,531 * 10/1974 Sloan ..... 40/406 X
4,111,363 * 9/1978 Kawamura et al. ..... 239/20
4,747,538 * 5/1988 Dunn et al. ..... 239/20
5,167,368 12/1992 Nash .
5,226,935 * 7/1993 Wolff et al. ..... 239/20 X
5,234,728 * 8/1993 Chiang ..... 40/406 X

* cited by examiner

*Primary Examiner*—David A. Scherbel
*Assistant Examiner*—Robin O. Evans
(74) *Attorney, Agent, or Firm*—Kremblas, Foster, Phillips & Pollick

(57) ABSTRACT

A sealed-cell waterfall display unit comprises a closed cell having front and back walls (20 & 22), side walls (24 & 26), and top and bottom panels (28 & 30); a reservoir for water in the top of the cell (32); a reservoir for water in the bottom of the cell (34); a pump (46) for conveying the water in the lower reservoir (34) to the upper reservoir (32), whereby the water overflows the upper reservoir (32) and flows down the front wall (20) in a waterfall fashion; and indentures (40) in the front wall (20) for producing a rippling effect in the flowing water.

10 Claims, 4 Drawing Sheets

42
28
36
54
54
44
38
40

32
52
44
36
54
28
42
58
38
50
40
48
20
24
26
34
46
30
56

SEALED-CELL WATERFALL DISPLAY UNIT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

1. Field of Invention

This invention pertains to waterfalls, and specifically to sheet or panel-type waterfalls.

2. Description of Prior Art

Water from a reservoir running over a dam, in such a manner as to create a dispersion, is noted to produce aesthetically and acoustically pleasing effects.

It is noted that this same effect can be duplicated in an artificial waterfall by using a thin angled panel, and allowing water to run down the panel. This panel may also have indentures that cause a rippling effect in the falling water.

Waterfalls such as those represented by the prior art allow water to collect in an upper reservoir, flow down an angled surface, and collect in a lower reservoir. The water is then re-circulated to the upper reservoir using a pump means, whereby the cycle may repeat.

U.S. Pat. No. 5,167,368 (1992) to Nash shows a waterfall providing a natural waterfall effect with accompanying acoustical effects.

U.S. Pat. No. 3,211,378 (1965) to Zysk is a wall fountain having a pool of water and a pump for raising water from the pool to a higher lever where it then falls over a vertical wall back into the pool.

The waterfalls described previously, and others like them, all suffer from a number of distinct disadvantages:

1) considerable water droplet splashing over a range of several feet from the base of the waterfalls;
2) significant evaporation of water to the point that refill may be required daily;
3) risk of water spillage during relocation of the waterfall; and
4) a large base to house a lower reservoir and a means for returning water to the upper reservoir.

SUMMARY OF THE INVENTION

In accordance with the present invention, a self-contained sealed-cell waterfall display unit comprises a closed cell having a front wall, a back wall, side walls, and top and bottom panels.

OBJECTS AND ADVANTAGES

It is an object of this invention to provide a sheet or panel-type waterfall.

It is also an object of this invention to provide a sheet or panel-type waterfall flowing down a front wall with indentures to induce a rippling effect as the water flows over it.

Besides the objects and advantages of the previously mentioned waterfalls, some of the objects and advantages of the present invention are:

1) to provide a waterfall enclosed in a sealed cell to prevent the splashing of water;
2) to provide a waterfall enclosed in a sealed cell to prevent evaporation;

3) to provide a waterfall enclosed in a sealed cell to negate the possibility of water spillage during relocation; and
4) to provide a waterfall enclosed in a sealed cell to eliminate the need for a reservoir or base which protrudes beyond the front panel, allowing for a minimal overall depth from a wall.

It is another object of this invention to have a lower reservoir for water, an upper reservoir with an overflow means, and a means for conveying water from the lower reservoir to the upper reservoir, whereby the water overflows the upper reservoir and returns to the lower reservoir in a waterfall fashion.

This waterfall display unit contemplates a unitary structure, which may be placed at any location or moved from site to site as needed. This waterfall display unit may also be placed in a shallow, framed cabinet or housing for purposes of mounting on a wall or displaying on a table or shelf.

These and other objects of the invention will become apparent to those skilled in the art to which the invention pertains as this description, taken in conjunction with the accompanying drawings, proceeds.

REFERENCE NUMERALS IN DRAWINGS

Figure 1:
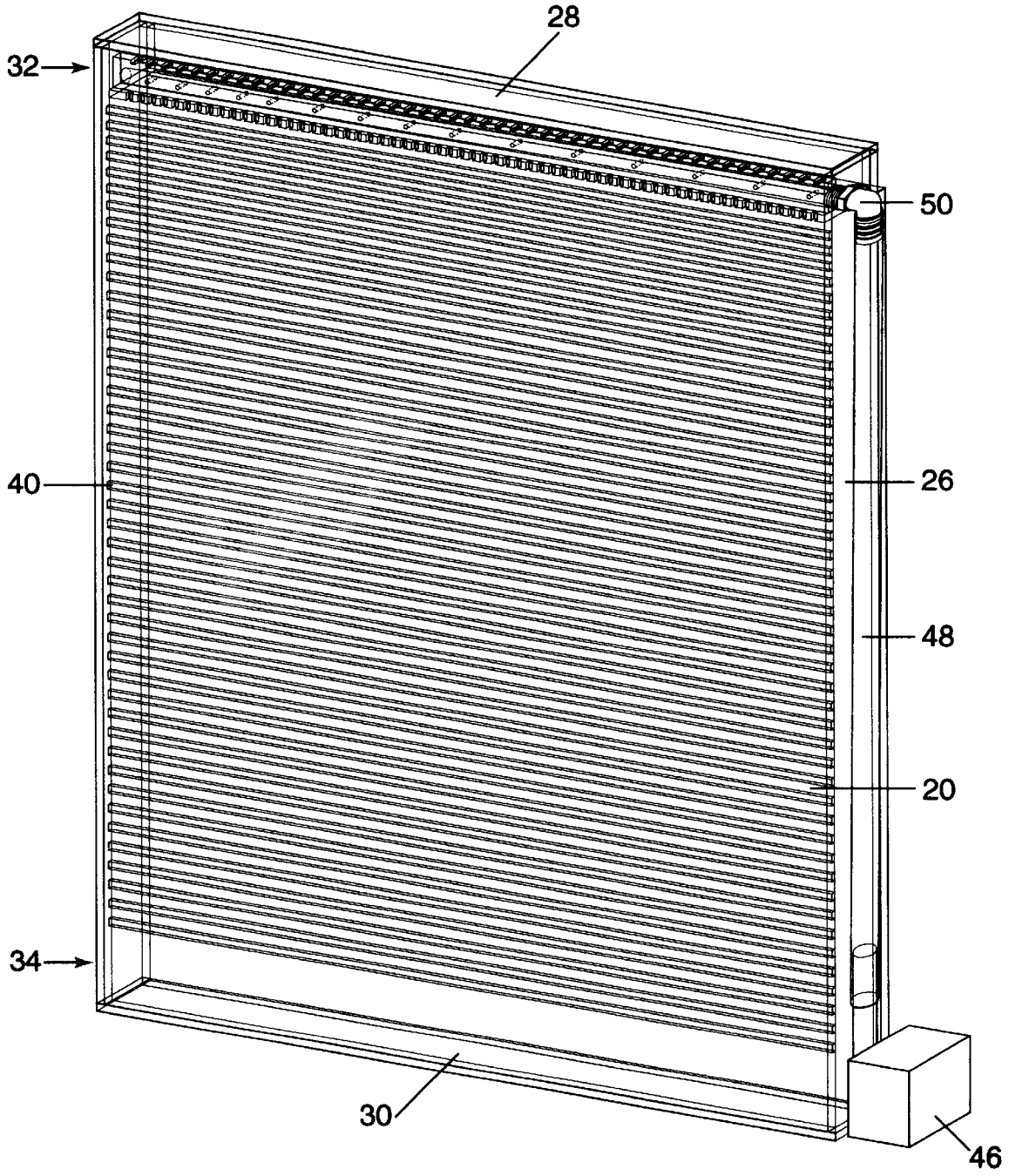
FIG. 1 is an angled view of the waterfall display unit showing: a front wall with horizontal indentures, a right side wall, a top panel, an upper reservoir, a lower reservoir, and a means for conveying water.

20) front wall
22) rear wall
24) left side wall
26) right side wall
28) top panel
30) bottom panel
32) upper reservoir
34) lower reservoir
36) vertical dam
38) horizontal dam
40) indentures in front wall
42) indentures in vertical dam

44) indentures in horizontal dam
46) means for conveyance of water
48) vertical pipe
50) inflow pipe elbow
52) horizontal inflow pipe
54) drain holes
56) outflow hole for water
58) inflow hole for water

DETAILED DESCRIPTION OF THE DRAWINGS

Referring now in more detail to the drawings, FIGS. 1–8 show a sealed-cell waterfall display unit comprising a rectangular cell having a front wall 20, of any desired length and width, joined to a top panel 28, a bottom panel 30, a left side wall 24, and a right side wall 26. A rear wall 22, located opposite front wall 20, joins side walls 24 & 26, top panel 28, and bottom panel 30.

Front wall 20 comprises on its interior surface a plurality of indentures 40 extending the width of the wall. The purpose of these indentures will be made clear later. (ref FIGS. 1, 2, 4, 5, & 6)

An upper reservoir 32 is created by rear wall 22, side walls 24 & 26, a vertical dam 36, and a horizontal dam 38. Vertical dam 36 joins to the upper surface of horizontal dam 38, is met by side walls 24 & 26, and is parallel to, but not touching, front wall 20. Horizontal dam 38 extends from front wall 20 to rear wall 22 and to both side walls 24 & 26, and is joined to vertical dam 36. A horizontal inflow pipe 52 resides between rear wall 22 and vertical dam 36, and above horizontal dam 38. (ref FIGS. 2, 4, & 5)

Figures 2, 3:
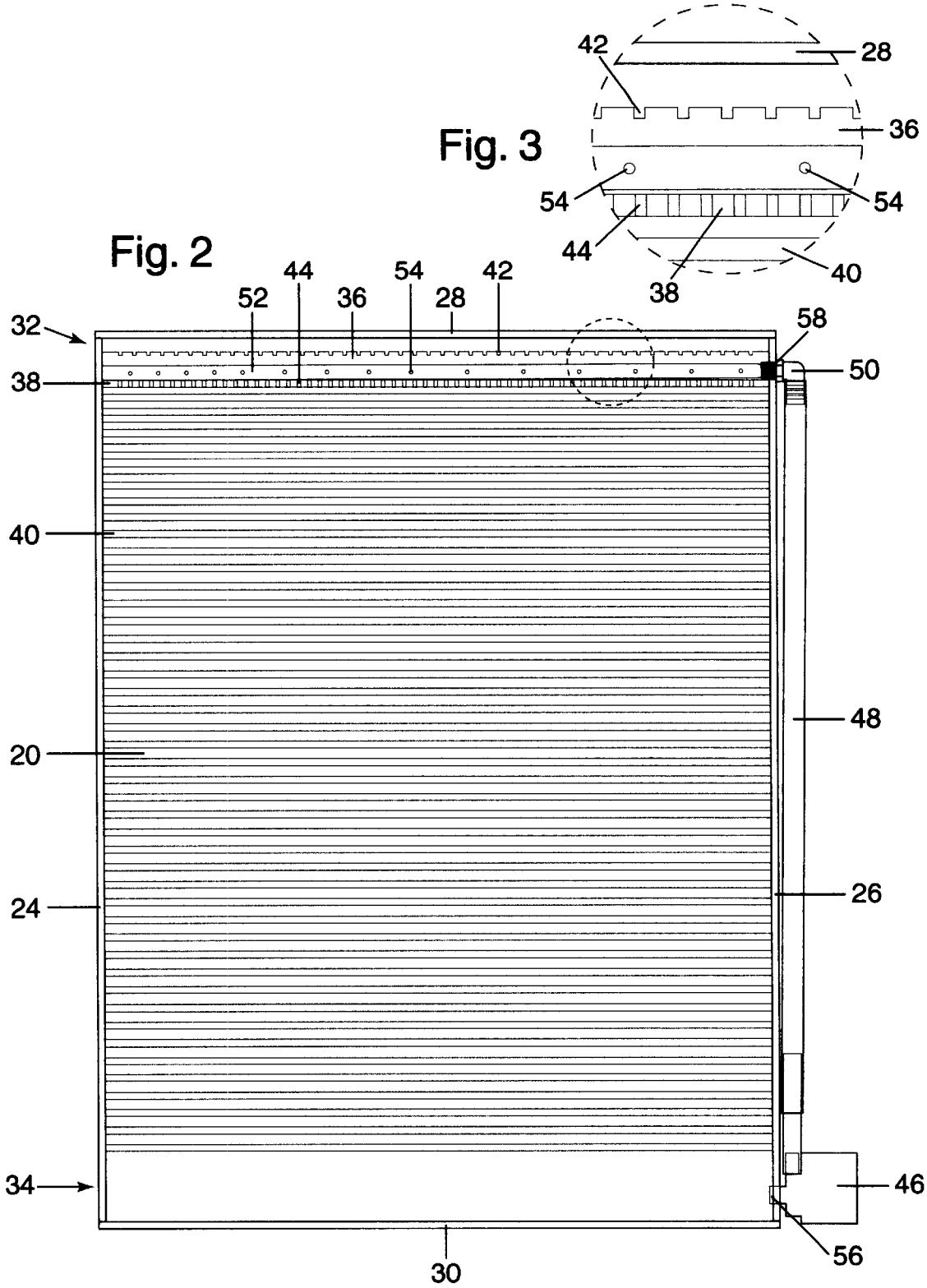
FIG. 2 is a vertical front view showing: the front wall with horizontal indentures, the upper and lower reservoirs, the top and bottom panels, the left and right side walls, the means for conveying water, and drain holes in a horizontal inflow pipe.
FIG. 3 is a front close-up view of indentures in vertical and horizontal dams, and the drain holes in the horizontal inflow pipe.
Figure 4:
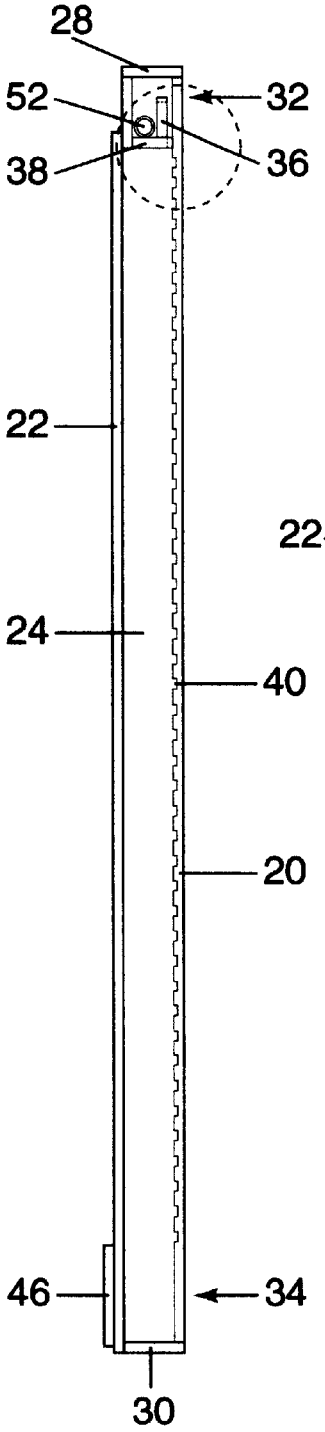
FIG. 4 is a vertical cross-sectional view of the left side of the waterfall display unit showing: the front wall and its indentures, the rear wall, the top and bottom panels, the upper and lower reservoirs, the vertical and horizontal dams and their indentures, and the horizontal inflow pipe.
Figure 8:
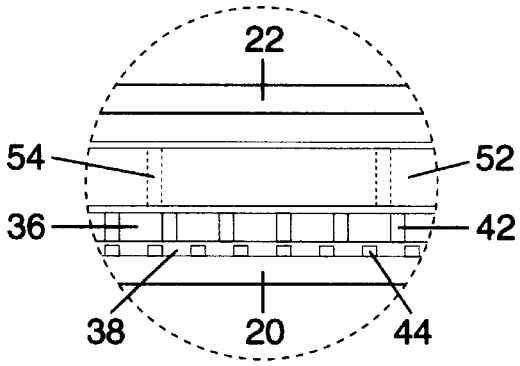
FIG. 8 is a close-up view of FIG. 7.

FIGS. 3 & 8 show close-up views of a plurality of indentures 42 in vertical dam 36, and a plurality of indentures 44 in horizontal dam 38.

FIG. 3 also shows a close-up view of a plurality of drain holes 54, drilled into the front and rear sides of horizontal inflow pipe 52. It can be seen in FIG. 2 that these drain holes 54 are decreasingly spaced apart, traversing from right side wall 26 to left side wall 24.

Figure 5:
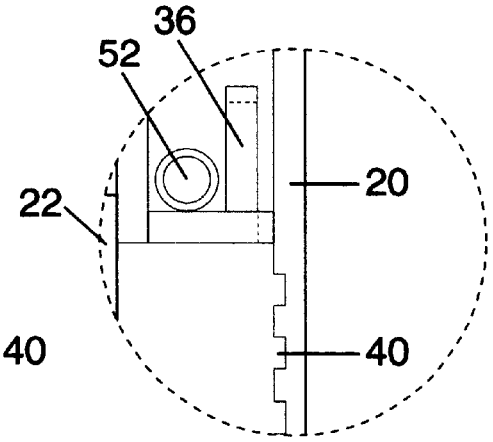
FIG. 5 is a left-side close-up view showing the indentures in the front wall, the horizontal inflow pipe, and the vertical and horizontal dams.
Figure 6:
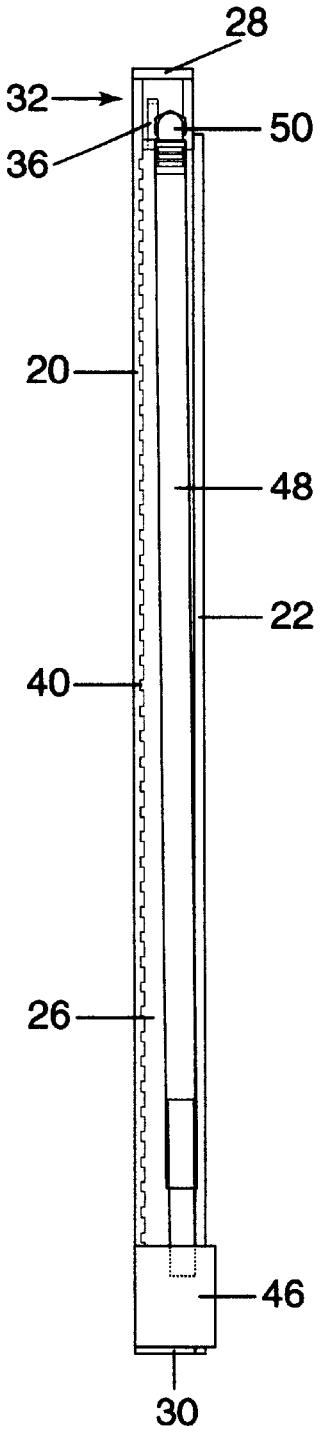
FIG. 6 is a vertical cross-sectional view of the right side of the waterfall display unit.

FIG. 5 shows indentures 40 in front wall 20. These indentures are sawed or milled into front wall 20, with a typical depth of 3.2 mm and a typical width of 6.4 mm. The indentures begin just below horizontal dam 38, with a spacing between indentures beginning at 6.4 mm and increasing to 12.7 mm just above a lower reservoir for water 34.

Figure 7:
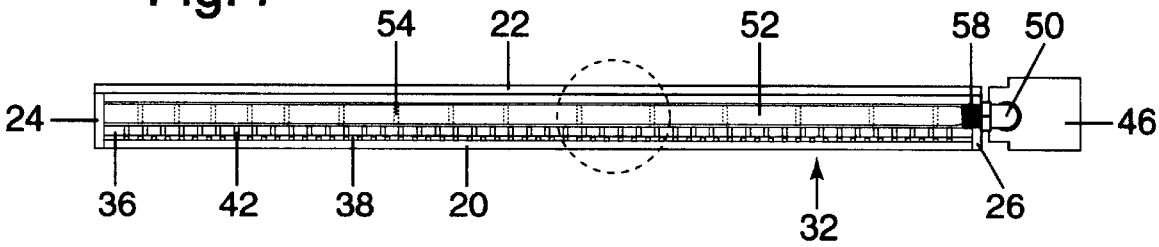
FIG. 7 is a top cross-sectional view more clearly illustrating the indentures in the vertical and horizontal dams, and the spacing of the drain holes in the horizontal inflow pipe.

FIGS. 7 & 8 illustrate in greater detail indentures 42 & 44 of vertical and horizontal dams 36 & 38, as well as drain holes 54 of horizontal inflow pipe 52. Further, it can be seen that indentures 44 in horizontal dam 38 extend away from where horizontal dam 38 joins to front wall 20.

Lower reservoir 34 for this display unit is defined as the volume contained by bottom panel 30, side walls 24 & 26, and extending upwards to a level in front wall 20 and rear wall 22 bounded by bottommost indenture 40 in front wall 20. (ref FIGS. 1, 2, 4, & 6)

The preferred means of conveyance for water for this display unit is a pump 46, externally adjoined to lower reservoir 34 at the bottom of the cell via an outflow hole for water 56. Connected to pump 46 is a vertical pipe 48 extending alongside right side wall 26. Vertical pipe 48 connects to an inflow pipe elbow 50, which in turn connects to horizontal inflow pipe 52 through an inflow hole for water 58 in right side wall 26 of upper reservoir 32. (ref FIGS. 1, 2, 6, & 7)

The preferred material for front wall 20, rear wall 22, side walls 24 & 26, top and bottom panels 28 & 30, and vertical and horizontal dams 36 & 38 is transparent acrylic, although other plastics or composite materials may be used. The preferred method of adjoining the walls, panels, and dams is plastic solvents. It is imperative that these adjuncts be watertight.

OPERATION

In operation, a lower reservoir 34 is filled with water to a sufficient volume such as to exceed the level of an outflow hole for water 58, to which a pump 46 is attached. When pump 46 is turned on, water is pumped from lower reservoir 34 through a vertical pipe 48, passing through an inflow pipe elbow 50 and into a horizontal inflow pipe 52. Water exits horizontal inflow pipe 52 through differentially-spaced drain holes 54, located in the front and rear of pipe 52. The purpose for the uneven spacing of the drain holes 54 is to evenly distribute the water along the width of the cell. The water then rises over a vertical dam 36 and passes through indentures 42 at the top of vertical dam 36. Water flows into the space between vertical dam 36 and the interior of a front wall 20. The purpose for indentures 42 & 44 is again to provide even distribution of water along the width of the cell. Water then falls through indentures 44 located on the front of a horizontal dam 38, where horizontal dam 38 is joined to front wall 20. These indentures 44 do not extend beyond vertical dam 36. Water then flows down front wall 20 and over indentures 40 in front wall 20; these indentures 40 create a rippling effect in the water. The water then collects in lower reservoir 34, to be re-circulated by pump 46.

CONCLUSIONS, RAMIFICATIONS, AND SCOPE

Accordingly, the reader will see that this invention provides for a sealed-cell waterfall display unit of the sheet or panel-type, that is aesthetically pleasing and functional beyond any previous inventions. In addition, this invention provides for a unitary device that may be located in a shallow, framed cabinet or housing to conceal all exterior sides and the means for conveying water. The entire device, contained within its cabinet or housing, may be relocated, without the need for draining the water or the possibility of spillage.

Furthermore, this invention has the additional options of:

1) placing an image or sign behind the rear wall—this image may be viewed through the front and rear walls, giving the illusion that the image is located behind or within the waterfall;
2) having a colored front wall;
3) having a front wall composed of a fluorescent material;
4) placing an external light source at the rear of the invention, within the cabinet. A fluorescent light source may be used to illuminate an image or sign. An ultraviolet light source may be used to give a luminescent glow to a fluorescent front wall, and still allow the falling water to be viewed; and
5) altering the angle of the indentures in the front wall, to produce a different type of rippling effect in the falling water.

I claim:

1. A self-contained sealed-cell waterfall display unit comprising a closed cell having a front wall, a back wall, side walls, top and bottom panels, and a reservoir for water in the upper portion of said closed cell, said front wall and back wall being joined to said side walls, said top and bottom panels being joined to said front wall, said back wall, and said side walls, said reservoir being defined by said back wall, said side walls, a vertical dam, and a horizontal dam.

2. The self-contained sealed-cell waterfall display unit according to claim 1 wherein said horizontal dam has an upper surface and said vertical dam is parallel to said front wall and is joined to said side walls and said upper surface of said horizontal dam.

3. The self-contained sealed-cell waterfall display unit according to claim 1 wherein said vertical dam has a top surface, said top surface having a plurality of vertical indentures.

4. The self-contained sealed-cell waterfall display unit according to claim 1 wherein said vertical dam has a bottom surface, said horizontal dam being parallel to said top panel, and being joined to said front wall, said side walls, and said bottom surface of said vertical dam.

5. The self-contained sealed-cell waterfall display unit according to claim 1 wherein said horizontal dam has a front surface, said front surface having a plurality of horizontal indentures where said horizontal dam joins said front wall.

6. A self-contained sealed-cell waterfall display unit comprising a closed cell having a front wall, a back wall, side walls, top and bottom panels, a reservoir for water in the upper portion of said closed cell, and a reservoir for water in the lower portion of said closed cell, said front wall having a bottommost indenture, said front wall and back wall being joined to said side walls, said top and bottom panels being joined to said front wall, said back wall, and said side walls, said reservoir for water in the low portion of said closed cell being defined as the volume contained by said bottom panel and said side walls extending upwards to a level in said front wall and said rear wall bounded by the bottommost indenture in said front wall.

7. A self-contained sealed-cell waterfall display unit comprising a closed cell having a front wall, a back wall, side walls, top and bottom panels, and a reservoir for water in the upper portion of said closed cell, and a reservoir for water in the lower portion of said closed cell, said front wall having an interior surface, said interior surface having a plurality of horizontal indentures, said front wall and back wall being joined to said side walls, said top and bottom panels being joined to said front wall, said back wall, and said side walls.

8. The self-contained sealed-cell waterfall display unit according to claim 7 wherein said reservoir for water in the upper portion of said closed cell includes a horizontal dam, said horizontal indentures beginning just below said horizontal dam and ceasing just below said reservoir for water in the lower portion of said closed cell.

9. The self-contained sealed-cell waterfall display unit according to claim 7 which includes means for carrying water from said reservoir for water in the lower portion of said closed cell to said reservoir for water in the upper portion of said closed cell, whereby said water overflows said upper reservoir and flows down said front wall and over said horizontal indentures in said front wall in a waterfall fashion.

10. The self-contained sealed-cell waterfall display unit according to claim 9 wherein said means for carrying water is a pump means.

* * * * *